US005708331A

United States Patent [19]

Vamvakas et al.

[11] Patent Number: 5,708,331

[45] Date of Patent: Jan. 13, 1998

[54] ELECTRODELESS LAMP WITH EXTERNAL INSULATIVE COATING

[75] Inventors: Spiro Vamvakas, Rocky River; Timothy A. Taubert, Kirtland, both of Ohio; Mahomed H. Girach, Leicester, England; Curtis E. Scott, Mentor; Vito J. Arsena, Highland Heights, both of Ohio

[73] Assignee: General Electric Company, Schenectady, N.Y.

[21] Appl. No.: 656,678

[22] Filed: May 31, 1996

[51] Int. Cl.[6] ..... H05B 41/16

[52] U.S. Cl. ..... 315/248; 315/344; 315/85; 313/573

[58] Field of Search ..... 315/248, 344, 315/39, 85; 313/573, 477 R, 479, 506

[56] References Cited

U.S. PATENT DOCUMENTS

| | | | |
|---|---|---|---|
| 4,010,400 | 3/1977 | Hollister | 315/248 |
| 4,266,167 | 5/1981 | Proud et al. | 315/248 |
| 4,727,294 | 2/1988 | Houkes et al. | 315/248 |
| 4,922,157 | 5/1990 | Van Engel et al. | 315/248 |
| 5,239,238 | 8/1993 | Bergervoet et al. | 315/248 |
| 5,412,280 | 5/1995 | Scott et al. | 315/248 X |

OTHER PUBLICATIONS (Advertisement), "Incandescent Lamps—General Electric," published by General Electric Company (1977), cover page and page 11.

*Primary Examiner*—Robert Pascal
*Assistant Examiner*—Haissa Philogene
*Attorney, Agent, or Firm*—George E. Hawranko

[57] ABSTRACT

An electrodeless, low pressure gas discharge lamp includes a vitreous envelope containing a discharge medium and being shaped with an external chamber for receiving an electrical excitation circuit. The excitation circuit is effective for exciting the discharge medium to emit light with electromagnetic fields that are generated by the excitation circuit. A circuit is included for supplying electrical power from power mains to the excitation circuit. A transparent, electrically conductive coating is provided atop the vitreous envelope and is electrically connected substantially directly to one of the power mains at any given time. A transparent, electrically insulative coating is disposed atop the electrically conductive coating, and comprises a contiguous, inorganic glass layer. The insulative coating preferably has a minimum coating thickness of at least about 3.1 microns.

15 Claims, 2 Drawing Sheets

ELECTRODELESS LAMP WITH EXTERNAL INSULATIVE COATING

CROSS-REFERENCE TO RELATED APPLICATION

The present application is related to application Ser. No. 08/420,543, entitled "Electrodeless Fluorescent Lamp Having an Electrically Conductive Transparent Coating and Cover Member Disposed Thereon," filed on Apr. 12, 1995, by David O. Wharmby et al., and assigned to the same assignee as the present application.

FIELD OF THE INVENTION

The present invention relates to an electrodeless lamp employing an insulative coating atop a conductive coating that is provided on a vitreous envelope for suppressing electromagnetic interference on mains that supply power to the lamp, and, more particularly, to an such an external insulative coating that prevents the hazard of an electrical shock to a user from the conductive coating.

BACKGROUND OF THE INVENTION

An electrodeless, low pressure (e.g. fluorescent) lamp incorporates a hermetically sealed vitreous envelope that typically contains a metal vapor and a rare gas. The envelope has an external chamber into which an excitation coil is received. The excitation coil electrically excites the metal vapor in the vitreous envelope to emit light by passing a high frequency electromagnetic field through the vitreous envelope. Without any electrodes within the envelope itself, the lamp is electrodeless. The high frequency electromagnetic field, however, can create undesirable electromagnetic interference (EMI) on the mains, or power lines, that supply electric power to the lamp.

To reduce such EMI to an acceptable level, U.S. Pat. No. 5,239,238 ('238 patent) teaches the use of a transparent, conductive coating on the exterior of the envelope for suppressing the EMI. The conductive coating is electrically coupled to the power mains in an manner suitable for suppressing EMI on the power mains. Being located on the exterior surface of the vitreous envelope, however, the conductive coating could present the hazard of electrical shock to a user who handles the lamp while installing it, for instance. To prevent a shock hazard to a user, the '238 patent teaches the use of a capacitor connected between the conductive layer and one of the power mains. As the patent teaches, such capacitor has an impedance as seen from the mains that is high for the mains frequency, so that no more than a small current, which is safe to touch, will then flow from the mains live terminal through the capacitor and the conductive layer.

With lamps of the foregoing type, voltages from the conductive layer to ground typically reach the line voltage on the power mains, e.g. 120 volts r.m.s. However, power surges from lightning, for instance, may cause voltages from the conductive layer to ground to reach 1,500 volts in an installation in the U.S.A., and 4,000 volts in an installation in Europe, the difference resulting from different grounding schemes employed in the two regions.

The mentioned capacitor of the '238 patent must conform to the standards of what is known in the an of EMI suppression as a line-by-pass capacitor. Such a capacitor is defined in Underwriters Laboratory standard UL 1414, dated May 4, 1989, as a capacitor connected between one side of a supply circuit and an accessible conductive part. As such, a line-by-pass capacitor needs to withstand the normal voltage of the mains, and any surge voltage on the mains, such as 1,500 or 4,000 volts. This is because its voltage can be large if a user who is at ground potential touches the conductive coating, whereupon the voltage across such capacitor can be that of the mains, including any surges. Accordingly, the mentioned capacitor is large and relatively expensive, typically more than the cost of any other parts of the ballast circuit. Furthermore, the present inventors were unable to find suitable line-by-pass capacitors for high temperature ballast environments, such as 120 degrees C.; typically line-by-pass capacitors are rated at only 85 degrees C. It would, therefore, be desirable to eliminate the need for a line-by-pass capacitor in a ballast circuit for an electrodeless lamp as described.

As one possibility of preventing a shock hazard, conformal coatings of silicone rubber, for instance, covering the outer conductive layer on bulbs, have been considered or tested by the present inventors, but found unsuitable. For instance, for lamp wattages sufficiently greater than 25, temperature environments of from 200 to 250 degrees C. can be encountered. Typical silicone rubber formulations available on the market are limited in their temperature tolerance only to about 204 degrees C., and would fail in a 250 degree C. environment. Additionally, silicone rubbers and other conformal coatings have been shown by the present inventors to often lack a very high degree of abrasion resistance, so that they can tear and lose dielectric (or insulative) integrity while a lamp is still operative. Even if such coatings do not tear, they typically absorb (and waste) about 2 to 5 percent of the light passed through them, and abrasion or scuffing only increases such absorption. Such conformal coatings, further, have been found by the present inventors to often lack the capacity of tenaciously adhering to a lamp bulb throughout the normal lifetime of a lamp, allowing slippage that results in tears and consequent loss of dielectric integrity.

OBJECTS AND SUMMARY OF THE INVENTION

Accordingly, an object of the present invention is to provide an electrodeless lamp with a highly abrasion-resistant and tenaciously clinging insulative outer coating to prevent the hazard of electrical shock from the high potentials that exist on an EMI-suppressing conductive coating on the exterior of a vitreous envelope of the lamp.

A further object of the invention is to provide an electrodeless lamp of the foregoing type that does not require a line-by-pass capacitor to reduce the hazard of electrical shock.

Another object of the invention is to provide an electrodeless lamp of the foregoing type wherein the insulative coating can tolerate a 200 to 250 degree C. temperature environment without loss of dielectric integrity.

An object of a specific embodiment of the invention is to provide an electrodeless lamp of the foregoing type incorporating a vitreous envelope formed of soda-lime-silicate glass.

In accordance with a preferred form of the invention, there is provided an electrodeless, low pressure gas discharge lamp. The lamp includes a vitreous envelope containing a discharge medium and being shaped with an external chamber for receiving an electrical excitation circuit. The excitation circuit is effective for exciting the discharge medium to emit light with electromagnetic fields that are generated by the excitation circuit. A circuit is included for supplying electrical power from power mains to the excitation circuit. A transparent, electrically conductive coating is provided atop the vitreous envelope and is electrically connected substantially directly to one of the power mains at any given time. A transparent, electrically insulative coating is disposed atop the electrically conductive coating, and comprises a contiguous, inorganic glass layer. The insulative coating preferably has a minimum coating thickness of at least about 3.1 microns.

BRIEF DESCRIPTION OF THE DRAWING FIGURES

The foregoing, and further, objects and advantages of the invention will become apparent from the following description when read in conjunction with the accompanying drawing figures, in which.

DESCRIPTION OF THE PREFERRED EMBODIMENTS

Figure 1:
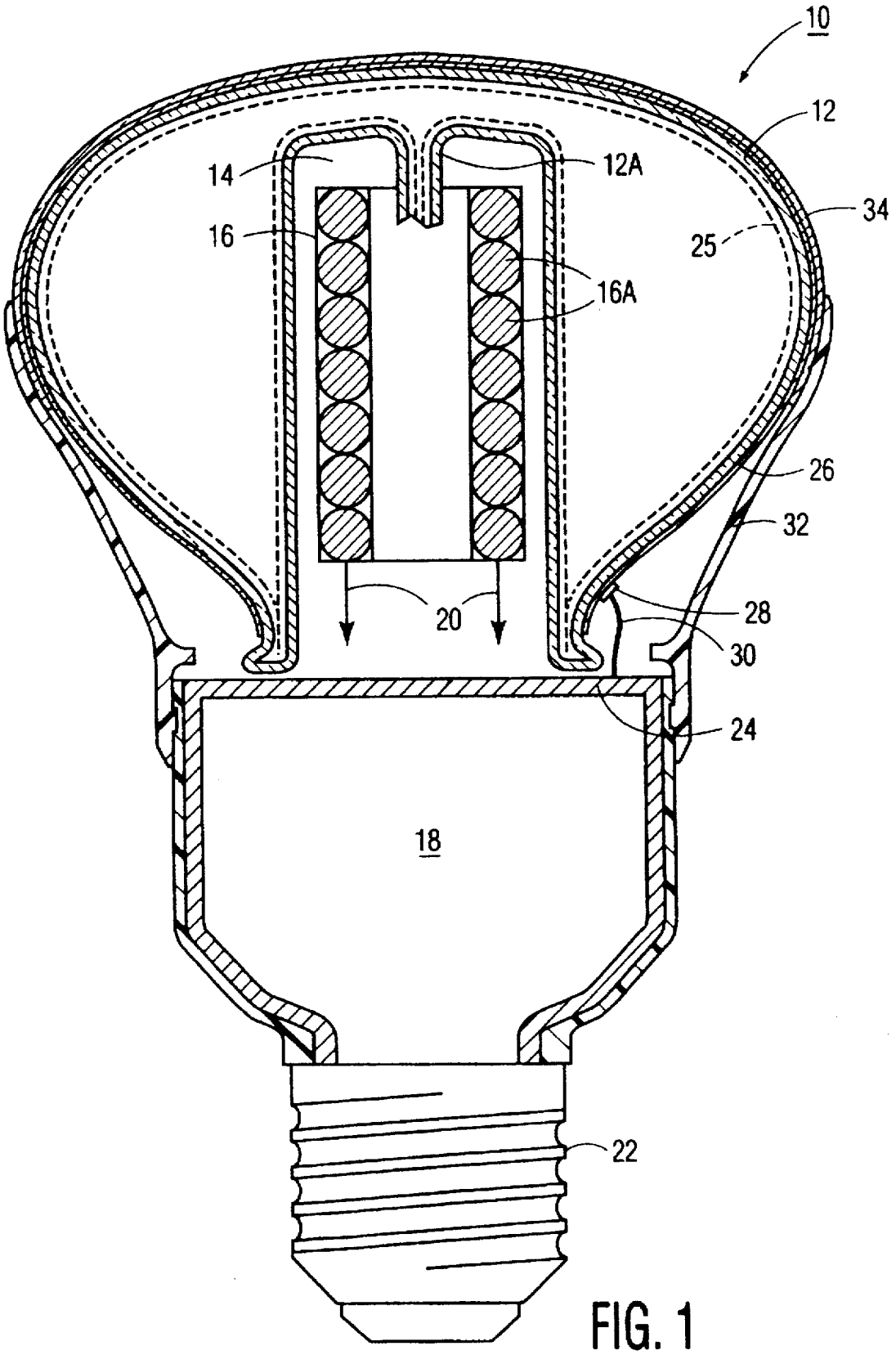
FIG. 1 is a simplified view of an electrodeless lamp, partially in cross section and partially cut away.

FIG. 1 is a simplified view of an electrodeless lamp 10 shown partially in cross section and partially cut away. Lamp 10 includes a vitreous envelope 12, such as soda-lime-silicate glass, that is hermetically sealed and that contains a metal vapor, such as mercury, and an inert gas such as argon. Vitreous envelope 12 is shaped with an external chamber 14 for receiving an electrical excitation coil 16. Coil 16 includes coil turns 16A whose cross sections are shown exaggerated in size. Coil 16 has a cylindrical shape, and a hollow interior through which stem 12A (shown partially cut away) of vitreous envelope 12 may extend. Coil 16 is electrically coupled to power supply, or ballast, circuit 18 via conductors 20, only part of which are shown; ballast circuit 18 is shown in schematic form as merely a block. Ballast circuit 18, in turn, is coupled to receive a.c. power from electrical supply mains via a screw-type base 22. A conductive shield 24 typically surrounds much of ballast circuit 18 for EMI-suppressing purposes.

Excitation coil 16 generates high frequency electromagnetic fields for exciting the metal vapor within envelope 12 to produce light. The electromagnetic fields, thus, pass through the adjacent walls of envelope 12 to reach the metal vapor inside the envelope. Where mercury is employed within envelope 12, ultraviolet light is generated, which is then transformed into visible light through interaction with a conventional coating system 25 on the interior of envelope 12. Coating system 25, shown as a dashed line, typically includes phosphor, may include a reflecting coating for focusing light generally upwards as viewed in FIG. 1, and may also include coatings to improve adhesion between layers.

The high frequency fields generated by excitation coil 16 can cause electromagnetic interference (EMI) on the power mains (not shown) that supply power to the lamp. In order to maintain such EMI within an acceptable range, the exterior of vitreous envelope 12 is provided with a transparent, conductive coating 26, such as fluorine-doped tin oxide or indium-doped tin oxide. Such coating typically has a so-called surface resistance value of from 80 to 300 ohms per square. Outer conductive coating 26 suppresses EMI on the power mains supplying the lamp; that is, it reduces such EMI to a tolerable level.

Figure 2:
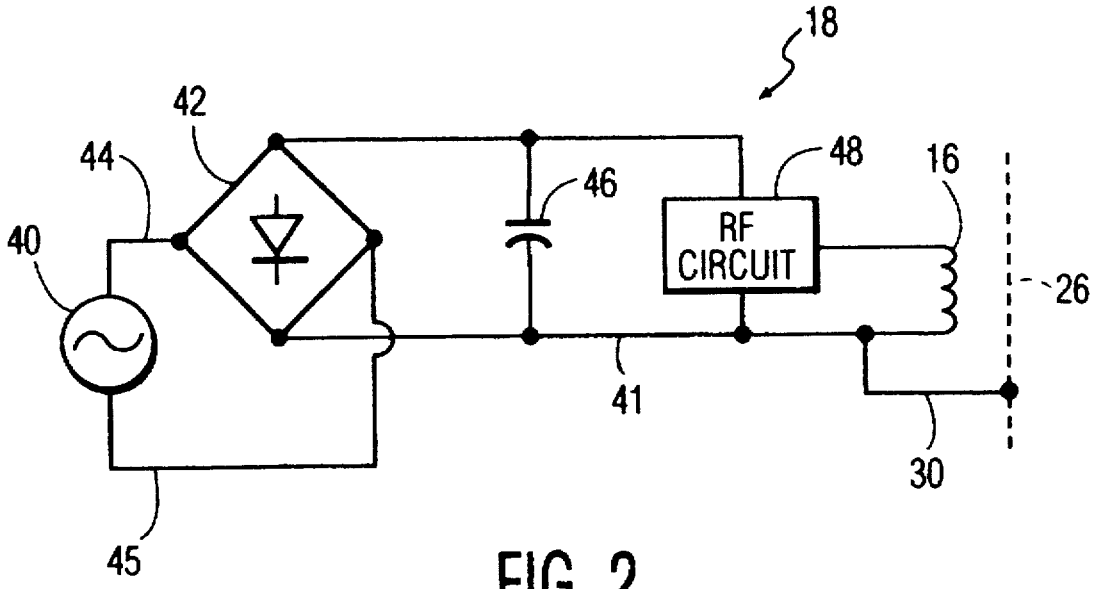
FIG. 2 is a schematic diagram of a circuit for powering an RF coil used in the lamp of FIG. 1, which shows an electrical connection between a transparent conductive coating on a lamp and power mains.

In order for inner conductive coating 26 to fulfill its EMI-suppressing function, it needs to be maintained at a suitable potential within ballast circuit 18. With reference to FIG. 2, schematically showing a ballast circuit 18 for supplying power from a source 40 to excitation coil 16, a suitable potential may, for instance, be the negative voltage output 41 of a full-wave rectifier 42 that rectifies a.c. voltage from power mains 44 and 45 to a d.c. voltage. Negative voltage output 41 is typically about 0.7 volts different from the voltage of one of the power mains 44 and 45, due to the typical 0.7 voltage drop across a p-n diode voltage (not shown) used in rectifier 42. Because a 0.7-volt difference between negative voltage output 41 and a potential of one of the mains (e.g., 120 volts r.m.s. above ground) is very small, conductive layer 26 is considered herein to be connected substantially directly to one of the power mains at any given time. In practice, it is connected first to one power main and then to the other, and so on, due to the operation of rectifier 42.

Referring back to FIG. 1, connection means 28 electrically couples outer conductive coating 26 to a lead 30 which, in turn, is connected to ballast circuit 18 preferably via conductive shield 24. Connection means 28 may, for instance, comprise a copper strip secured to an outer portion of outer conductive coating 26 by a conductive adhesive, or a solder connection to conductive coating 26.

Referring again to FIG. 2, a capacitor 46 smooths the output of bridge 42, which is then provided to an RF circuit 48 for powering excitation coil 16. Conductive coating 26 of the lamp is shown as a dashed line, and, as mentioned above, serves to reduce EMI from the excitation coil. A lead 30 directly connects one end of coil 16 to conductive coating 26. This is in contrast with the use of a capacitor interposed in lead 30, which is essentially what is done in the above-mentioned '238 patent; however, the capacitor in such patent may be connected directly to one of the power mains as opposed to being connected to a power main through a p-n diode of a full-wave bridge as is preferably done in this invention. The illustrated embodiment of the invention thus avoids the need to employ a line-by-pass capacitor to reduce the hazard of electrical shock, and thereby avoids the above-mentioned drawbacks of requiring a line-by-pass capacitor, including lack of ready availability for capacitors rated to operate in 120 degree C. ballast environments, such as characterizes certain embodiments of the present invention.

Referring again to FIG. 1, to prevent an electrical shock hazard to a user, a plastic skirt 32 covers the exposed region of outer conductive coating 26 where connection means 28 is provided. In accordance with the invention, a transparent insulative coating (or layer) 34 is provided over the entire periphery of outer conductive layer 26 that is not covered by plastic skirt 32, with such insulative coating 34 extending some distance beneath the plastic skirt.

Insulative coating 34 may be suitably formed by with a glass frit. The glass frit should have a lower softening temperature than vitreous envelope 12 and should be temperature tolerant (e.g. 200–250 degrees C.). With typical thicknesses of coating 24 as mentioned below, the glass frit also should have a coefficient of thermal expansion sufficiently close to that of vitreous envelope 12 to be able to withstand thermal cycling encountered during use. Because conductive layer 26 is typically very thin (e.g., 0.2–0.5 microns), it effectively conforms to the thermal expansion characteristics of vitreous envelope 12.

In forming insulative coating 34, a mixture of the mentioned glass frit, suspended in an organic medium, may be applied to the exterior of conductive coating 26 in a desired pattern. Vitreous envelope 12 with coating 26 thereon and the patterned mixture are then fired to remove the organic medium and cause the glass frit to fuse and form a contiguous, inorganic layer of glass. Such inorganic glass layer bonds to the exterior of conductive coating 26.

The patterning of a non-fired mixture of glass frit suspended in an organic medium can be carried out in various ways. Such composition may be applied with a paint roller, or it may be thinned with a volatile solvent and brushed or sprayed on. Additionally, such unfired composition can be patterned on the envelope by gravure transfer printing, or by silk screening.

In one example of preparing a conductive enamel, a vitreous envelope 12 comprising soda-lime-silicate glass was used, which is preferable due to its low cost. The soda-lime-silicate glass has typical weight composition ranges as follows: $SiO_2$, 65–75%; $Na_2O$, 12–20%; CaO, 4–6%; MgO, 3–4%; $Al_2O_3$, 0.3–2%; $K_2O_3$, 0.3–2%; and $Fe_2O_3$, 0.02–0.06%. Such glass is available, for instance, from the General Electric Company of Cleveland, Ohio under the product designation GE-008. In forming insulative layer 34, a mixture of 100 grams of glass frit comprising lead-borosilicate ($PbO—SiO_2—B_2O_3$) was mixed with 100 milliliters of an organic medium comprising methanol in a one-pint cylindrical plastic bottle with an inner diameter of about 68 mm. Spherical alumina milling media of ½ inch diameter were placed in the mixture, occupying about one-quarter of the resulting volume. The mixture was rolled for one hour at a r.p.m. of about 50. The resulting mixture was diluted as needed to allow spraying. An electrodeless lamp 12 with about 125 square centimeters to be coated was sprayed with the mixture until its unfired weight increased about one gram. Firing then proceeded for three consecutive time period of 10 minutes each, at the respective temperatures of 60 degrees C., 250 degrees C., and above 500 degrees C. (oven set at 550 degrees C.).

In order to achieve a voltage withstand capability of about 1,500 volts, several coatings formed in the foregoing manner may be used. In one embodiment, with the lead-borosilicate composition applied as mentioned above, one coat provided a voltage-withstand capability of 500 volts; two coats, a voltage-withstand capability of 750 volts; and three coats, a voltage-withstand capability of 1,000 volts. The more coats, the higher the voltage withstand capability. For the mentioned lead-borosilicate composition, a voltage withstand capability of 1,500 volts is achieved by a minimum coating thickness of about 3.1 microns, and a voltage withstand capability of 4,000 volts is achieved by a minimum coating thickness of about 8.3 microns. These figures are for ideal conditions, i.e., without defects or imperfections in the lead-borosilicate layer, or in underlying conductive layer 26. More practically, the minimum thicknesses should be somewhat, e.g., 50 percent, greater, or 4.6 and 12.4 microns, respectively, to meet the foregoing voltage-withstand values. For zinc-borosilicate, greater thicknesses are required than for lead-borosilicate.

Insulative coating 34 may be suitably used with a vitreous envelope formed of materials other than soda-lime-silicate glass such as borosilicate glass, quartz or ceramic. Because the mentioned materials have a higher softening temperature than soda-lime-silicate glass, a higher temperature glass frit can be used, if desired, to form insulative layer 34, such as zinc borosilicate. If the vitreous envelope is formed of borosilicate glass, boron would typically be included in a glass frit, e.g., zinc or lead borosilicate, to lower its coefficient of thermal expansion.

To allow the elimination of line by-pass capacitor as mentioned above, insulative coating 34 provides a robust dielectric separation between conductive coating 26 and the exterior of lamp 10. Insulative coating 34, moreover, has been found by the present inventors to exhibit high abrasion resistance, and tenacious clinging throughout a typical lifetime of an electrodeless lamp. Such properties are especially important in the absence of a line by-pass capacitor to prevent the hazard of electrical shock to a user.

From the foregoing, it will be appreciated that the present invention provides an electrodeless lamp with a highly abrasion-resistant, and tenaciously clinging insulative outer coating to prevent the hazard of electrical shock from the high potentials that exist on an EMI-suppressing conductive coating on the exterior of a vitreous envelope of the lamp. The lamp can be made without the need for a line-by-pass capacitor to reduce the shock hazard. The insulative coating can tolerate a 200 to 250 degree C. temperature environment without loss of dielectric integrity. In a specific embodiment, the vitreous envelope of the lamp comprises soda-lime-silicate glass, which is of low cost relative to many other materials.

While the invention has been described with respect to specific embodiments by way of illustration, many modifications and changes will occur to those skilled in the art. It is, therefore, to be understood that the appended claims are intended to cover all such modifications and changes as fall within the true scope and spirit of the invention.

What is claimed is:

1. An electrodeless, low pressure gas discharge lamp, comprising:

(a) a vitreous envelope containing a discharge medium, said envelope being shaped with an external chamber for receiving an electrical excitation circuit and having a surface facing outwardly formed of adjoining non-overlapping first and second sides;

(b) said excitation circuit being effective for exciting said discharge medium to emit light with electromagnetic fields that are generated by said excitation circuit;

(c) a circuit for sulpplying electrical power from power mains to said excitation circuit;

(d) a housin for said circuit;

(e) an electrically insulative skirt depending from said housing and aproximately encircling said first side of said envelop;

(f) a transparent, electrically conductive coating atop said vitreous envelope that is ohmically connected to said circuit, and, through said circuit, is electrically connected substantially directly to one of said power mains at any given time; and (g) a transparent, electrically insulative coating comprising a contigous, inorganic glass layer; said insulative coating being disposed atop said electrically conductive coating, extending fully over said second side of said envelope, and further extending over said first side, beneath said skirt, for a redetermined distance.

2. The gas discharge lamp of claim 1, wherein said vitreous envelope comprises soda-lime-silicate glass.

3. The gas discharge lamp of claim 2, wherein said insulative coating comprises lead-borosilicate glass.

4. The gas discharge lamp of claim 1, wherein said vitreous envelope comprises borosilicate glass.

5. The gas discharge lamp of claim 4, wherein said insulative coating comprises boron.

6. An electrodeless, low pressure gas discharge lamp, comprising:

(a) a vitreous envelope containing a discharge medium, said envelope being shaped with an external chamber for receiving an electrical excitation circuit and having a surface facing outwardly formed of adjoining, non-overlapping first and second sides;

(b) said excitation circuit being effective for exciting said discharge medium to emit light with electromagnetic fields that are generated by said excitation circuit;

(c) a circuit for supplying electrical power from power mains to said excitation circuit;

(d) a housing for said circuit;

(e) an electrically insulative skirt depending from said housing and aproximately encircling said first side of said envelope;

(f) a transparent, electrically conductive coating atop said vitreous envelope that is ohmically connected to said circuit, and, through said circuit, is electrically connected substantially directly to one of said power mains at any given time;

(g) a transparent, electrically insulative coating comprising a contigous, inorganic glass layer; said insulative coating being disposed atop said electrically conductive coating, extending fully over said second side of said envelope, and further extending over said first side, beneath said skirt, for a redetermined distance; and (h) said insulative coating having a minimum coating thickness of at least about 3.1 microns.

7. The gas discharge lamp of claim 6, wherein said insulative coating has a minimum coating thickness of at least about 4.6 microns.

8. The gas discharge lamp of claim 6, wherein said insulative coating has a minimum coating thickness of at least about 8.3 microns.

9. The gas discharge lamp of claim 6, wherein said insulative coating has a minimum coating thickness of at least about 12.4 microns.

10. The gas discharge lamp of claim 6, wherein said vitreous envelope comprises soda-lime-silicate glass.

11. The gas discharge lamp of claim 10, wherein said insulative coating comprises lead-borosilicate glass.

12. The gas discharge lamp of claim 11, wherein said insulative coating has a minimum coating thickness of at least about 4.6 microns.

13. The gas discharge lamp of claim 6, wherein said vitreous envelope comprises borosilicate glass.

14. The gas discharge lamp of claim 13, wherein said insulative coating comprises boron.

15. The gas discharge lamp of claim 6, wherein said insulative coating comprises zinc borosilicate.

* * * * *